US009596903B2

(12) United States Patent
Byam et al.

(10) Patent No.: US 9,596,903 B2
(45) Date of Patent: Mar. 21, 2017

(54) SHOE TO BOOT CONVERSION SYSTEM

(71) Applicants: Monique Byam, New York City, NY (US); Jennifer Ralph, Jersey City, NJ (US)

(72) Inventors: Monique Byam, New York City, NY (US); Jennifer Ralph, Jersey City, NJ (US)

( * ) Notice: Subject to any disclaimer, the term of this patent is extended or adjusted under 35 U.S.C. 154(b) by 424 days.

(21) Appl. No.: 14/104,700

(22) Filed: Dec. 12, 2013

(65) Prior Publication Data

US 2014/0165425 A1 Jun. 19, 2014

Related U.S. Application Data

(60) Provisional application No. 61/736,619, filed on Dec. 13, 2012.

(51) Int. Cl.
*A43B 3/24* (2006.01)
*A43B 1/00* (2006.01)

(52) U.S. Cl.
CPC ..... *A43B 1/0081* (2013.01); *A43B 3/242* (2013.01); *A43B 3/244* (2013.01)

(58) Field of Classification Search
CPC ..... A43B 3/242; A43B 3/244; A41D 17/00; A41D 17/05
USPC ..... 36/1.5, 2 R
See application file for complete search history.

(56) References Cited

U.S. PATENT DOCUMENTS 416,676 A * 12/1889 Harris ..... A43B 3/02 2/227
1,187,663 A * 6/1916 Segal ..... A43B 3/02 36/1.5
1,712,035 A * 5/1929 Frykman ..... A43B 3/02 36/1.5
1,736,013 A * 11/1929 Peachey ..... A43B 5/001 36/1.5
1,844,997 A * 2/1932 Weigle ..... A41D 17/00 36/1.5
2,053,813 A * 9/1936 Brennan ..... A41D 17/00 36/1.5
4,064,641 A * 12/1977 Levine ..... A43B 3/24 2/232
4,771,553 A * 9/1988 Smithdeal ..... A43D 3/1416 12/128 R

FOREIGN PATENT DOCUMENTS

CH 186529 A * 9/1936 ..... A41D 17/00

* cited by examiner

*Primary Examiner* — Ted Kavanaugh
(74) *Attorney, Agent, or Firm* — Craig J. Levick; Larkin Hoffman Daly & Lindgren Ltd.

(57) ABSTRACT

A footwear conversion system is described herein that allows a user's shoe to be worn as a regular high heeled shoe or as an ankle boot and to be able to convert same without any special tools or complex assembly or disassembly steps.

9 Claims, 7 Drawing Sheets

SHOE TO BOOT CONVERSION SYSTEM

PRIORITY CLAIM

This application claims priority to U.S. Provisional Patent Application No. 61/736,619, filed on Dec. 13, 2012.

FIELD OF THE INVENTION

The invention relates generally to footwear. There are a number of accessories associated with changing the appearance of a shoe. One solution is two permanently alter a shoe by removing a portion of the shoe and changing its overall look. One such example is to remove a portion of the shoe that surrounds the ankle region to covert a high top shoe to a low-top shoe. Another method of altering a shoes appearance is to removeably clip ornamental brooches and the like on the tops of shoes. Examples of removable shoe ornaments are described in U.S. Pat. No. 7,891,117, U.S. Pat. No. 7,895,774 and U.S. Design Pat. No. 649,340. However, these solutions fail to meet the needs of the industry because they are aimed at adding ornamentation to a shoe and not changing the overall shoe type.

It would be desirable to have a system and method that enables people to have a couple of style options without having to buy multiple styles of shoes. Therefore, there currently exists a need in the industry for a system and device that can be easily converted to change footwear.

SUMMARY OF THE INVENTION

Various example embodiments of the invention advantageously fill the aforementioned deficiencies by providing a shoe conversion system which provides multiple style options with only one pair of shoes. In one example embodiment, a shoe has removable pieces that allow a wearer to choose from a boot or a shoe style. The shoe gives the wearer two options of changing the look of the shoe from a boot to a regular high heel. This shoe gives options to the wearer with one item. In this example embodiment, a user can zip or unzip the top piece to change the look of your shoe while it's still on the user's foot.

In another example embodiment, a method is provided for transforming a shoe to a boot or vice versa without the use of tools for the conversion.

The invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

DETAILED DESCRIPTION OF THE INVENTION

Figure 1:
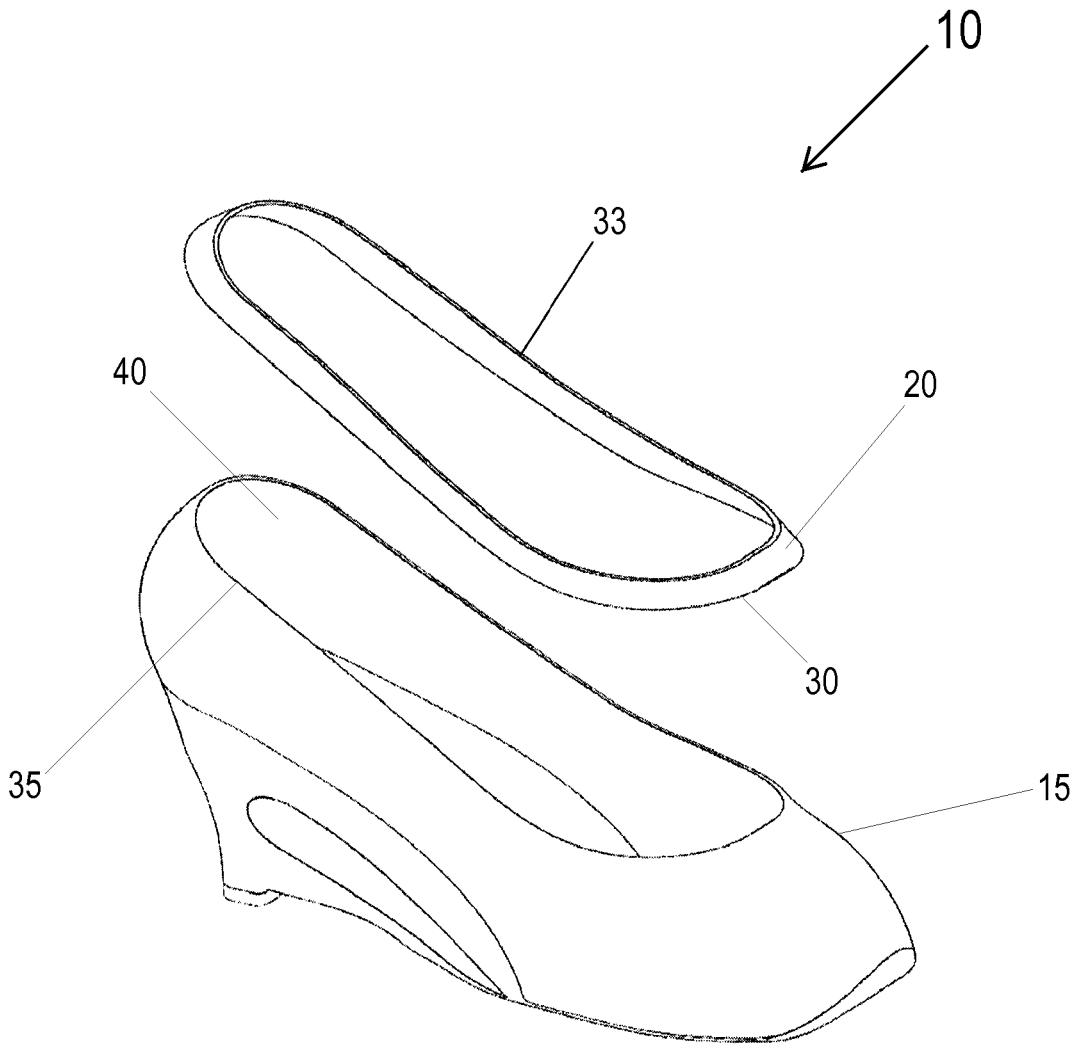
FIG. 1 shows a first footwear and a coupling member prior to attachment.

Referring now to the various Figures, where like reference numerals designate similar parts throughout the several views. Referring now to FIGS. 1-5 where a footwear conversion system 10 generally includes footwear 15, a coupling member 20 and a footwear cover 25. The footwear conversion system 10 is ideal for converting shoes from a single type of footwear, such as a high heel or low-top shoe to a fundamentally different style, such as a boot.

Figure 2:
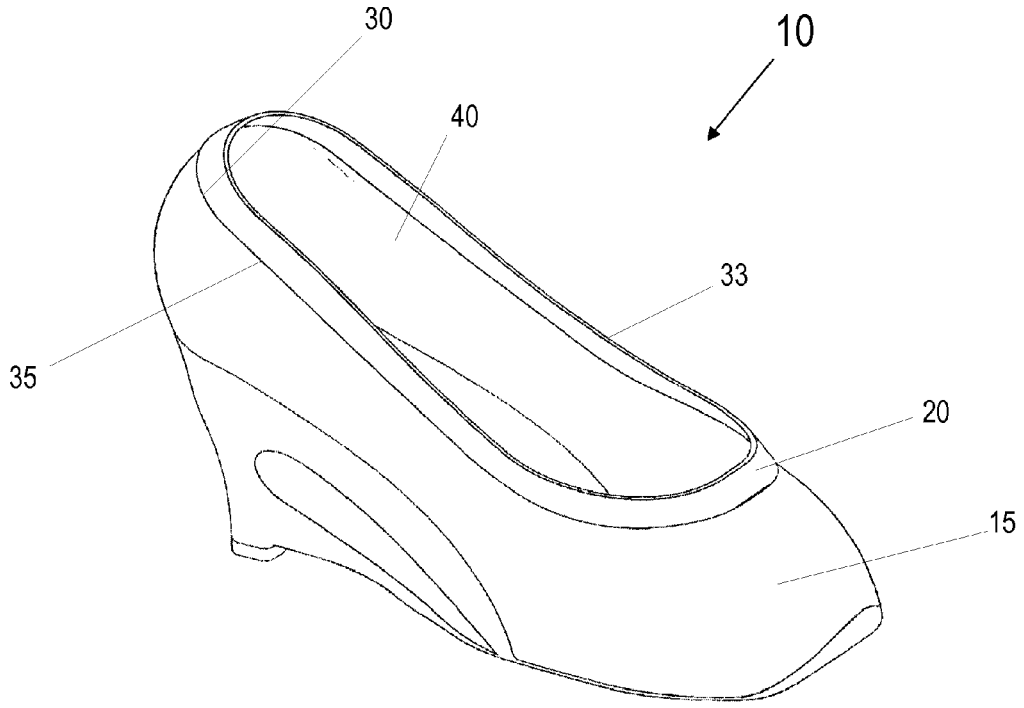
FIG. 2 shows a front perspective view of a first footwear type and a coupling member after attachment.
Figure 3:
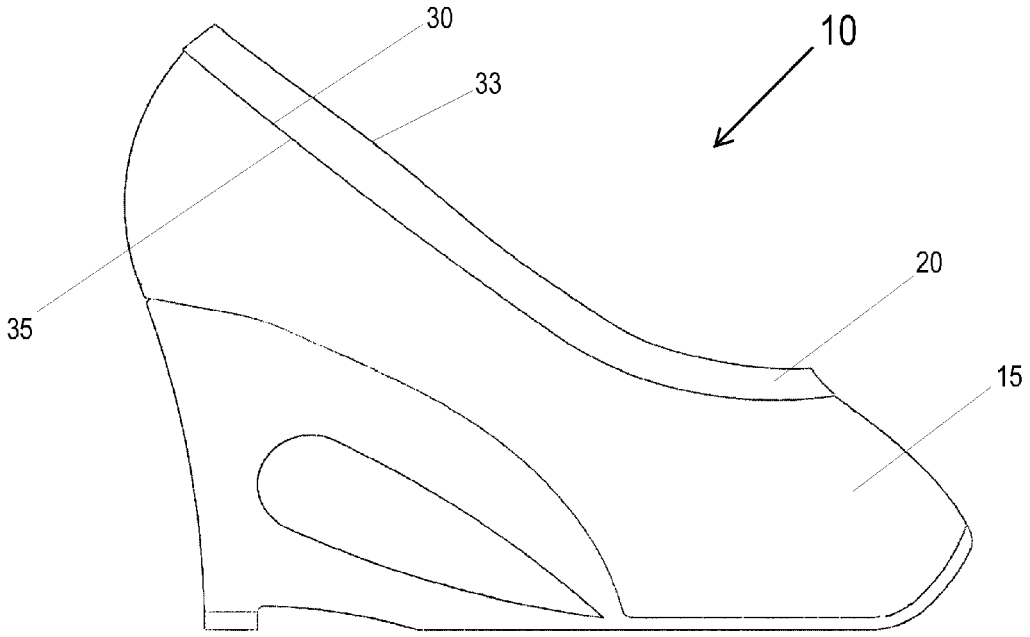
FIG. 3 shows a side elevation view of a first footwear type and a coupling member after attachment.

Referring specifically to FIGS. 1-3 which describes footwear 15 being coupled to coupling member 20. It should be appreciated that coupling member 20 is connected to footwear 15 in a manner that is conveniently connected and disconnected from footwear 15 when a user desires to use footwear conversion system 10. However, the connection between footwear 15 and coupling member 20 should be robust to avoid disengagement when a user is utilizing the shoe under normal use conditions, such as walking, sitting, standing, jogging and the like.

The connection edge 30 of coupling member will typically receive at least a portion of a footwear aperture edge 35. As shown in FIG. 1, coupling member 20 is positioned adjacent footwear aperture edge 35 prior to converting footwear 15. Once placed above footwear aperture 40, coupling member 20 is positioned on, or adjacent, footwear aperture 40, as best shown in FIGS. 2 and 3. In some example embodiments, coupling member will have a means of snapping directly onto footwear 15. In other related embodiments, coupling member 20 will be mechanically connected by fasteners know by one of ordinary skill in the art. Theses fastening means include, but are not limited to, zippers, button, and snaps positioned along or adjacent footwear aperture edge 35. In these example embodiments, coupling member 20 will have reciprocal fastening means to pair with those fastening means positioned along the footwear aperture edge 35.

Figure 4:
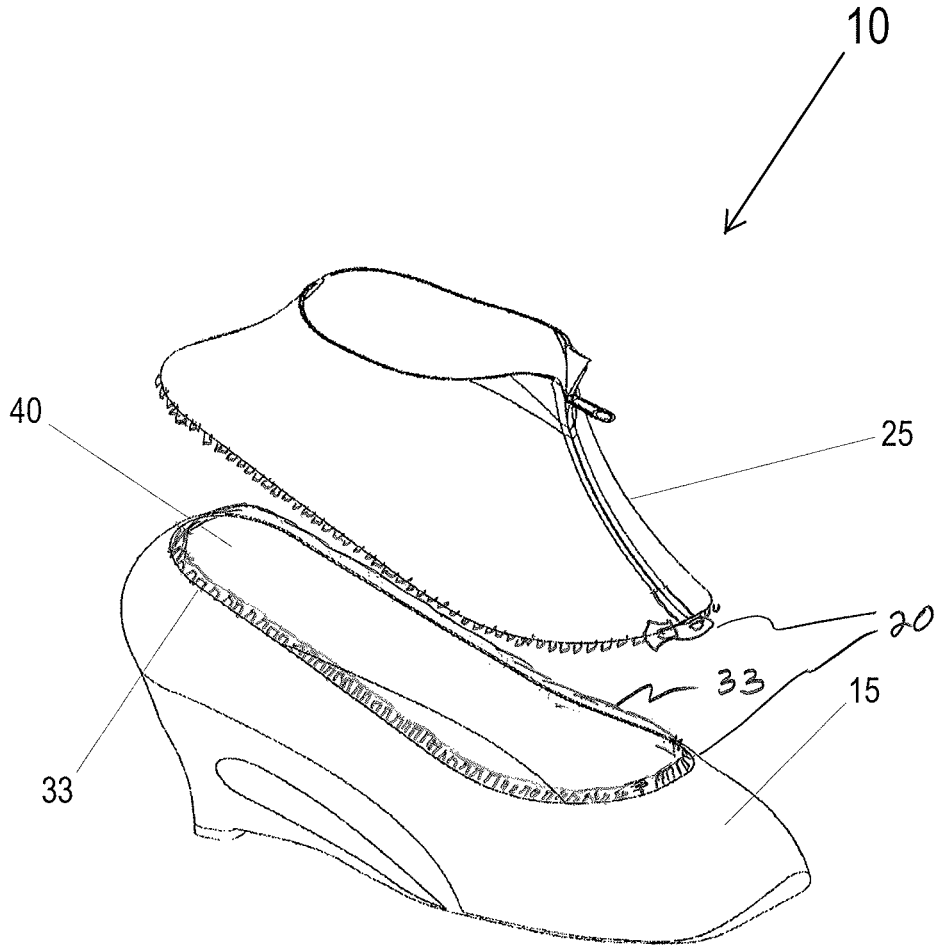
FIG. 4 shows a front perspective view.
Figure 4A:
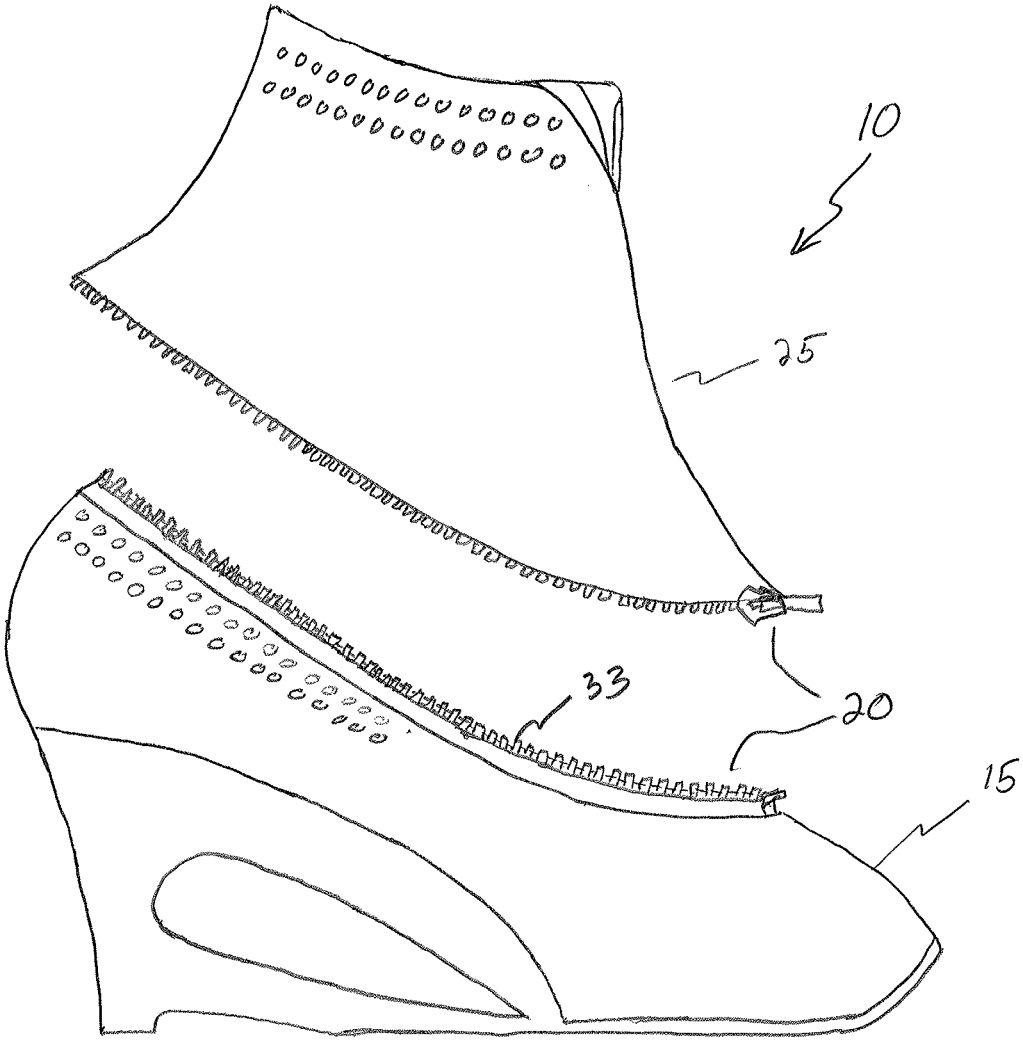
FIG. 4A shows a side view of a first footwear type and a footwear cover prior to attachment.
Figure 5:
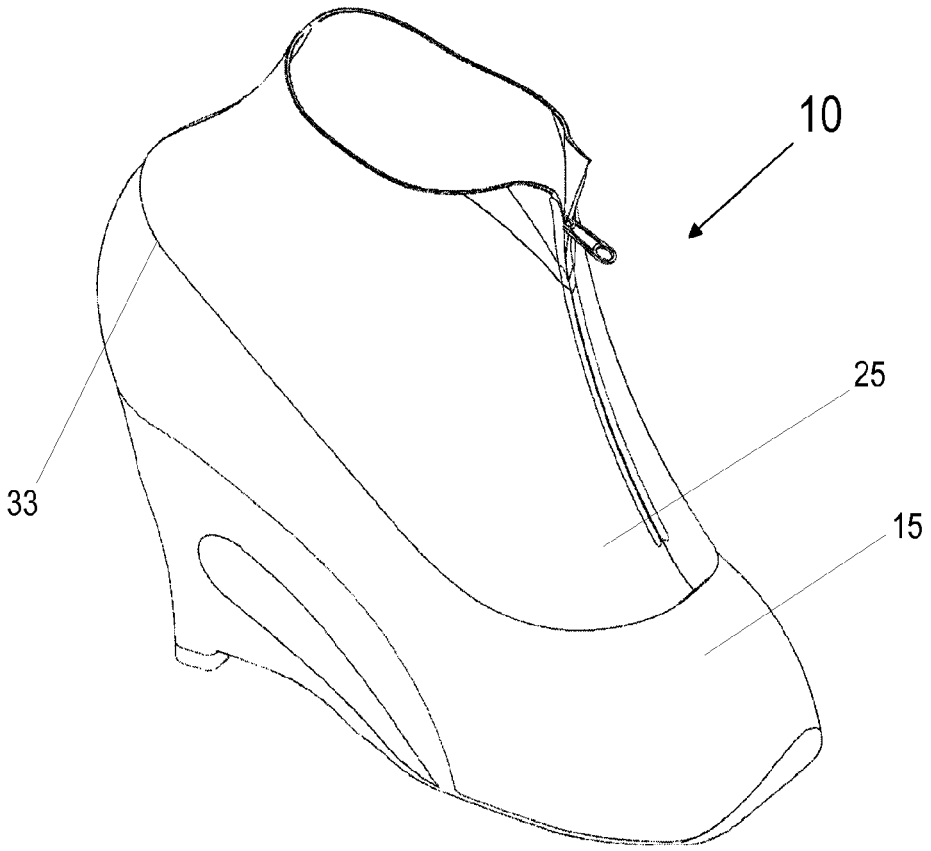
FIG. 5 shows a front perspective view of a second footwear type.
Figure 6:
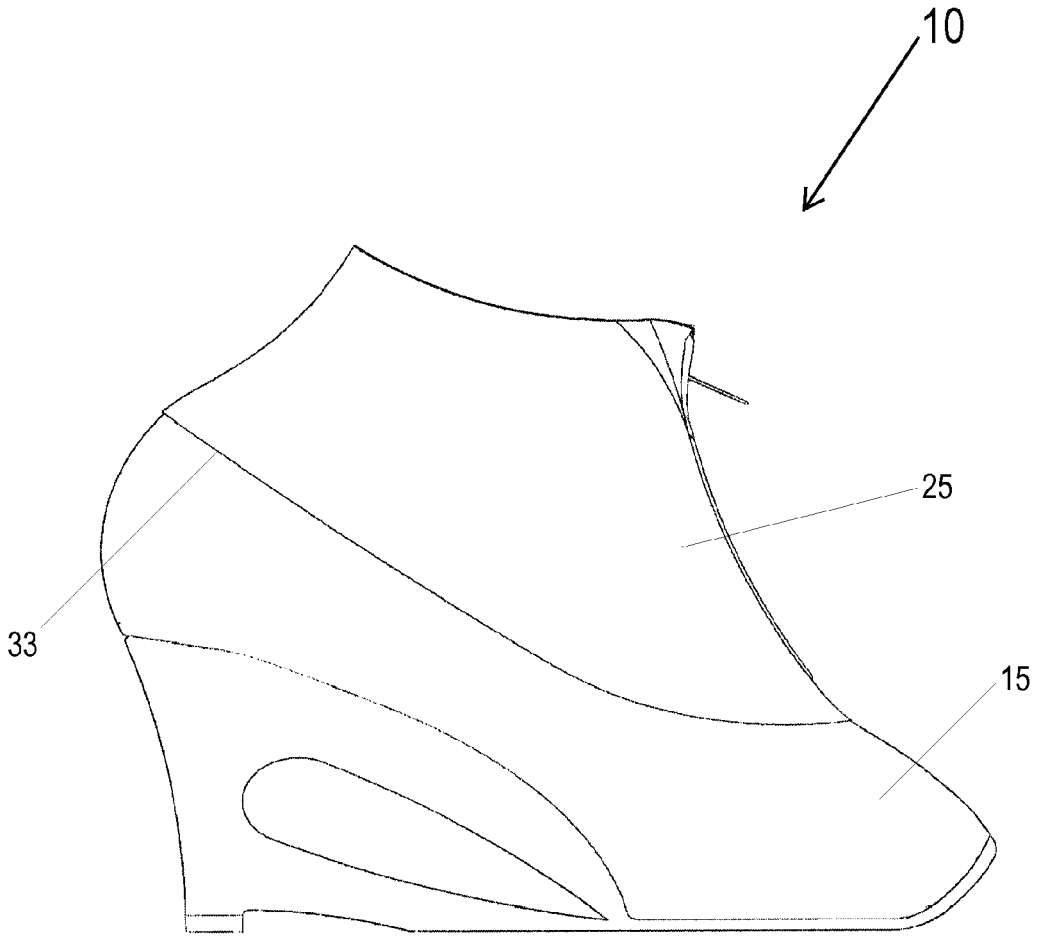
FIG. 6 shows a side elevation view of a second footwear type.

Once footwear aperture edge 35 and coupling member 20 are connected (e.g., using fastening means 50, such as a zipper, as schematically illustrated), they become integrally related to form an upper connection edge 33 where footwear cover 25 can be positioned above coupling member 20, as shown in FIGS. 4 & 4A. Once coupling member 20 is appropriately positioned, footwear cover 25 can be fastened to coupling member 20 (e.g., using fastening means 52, such as a zipper, as schematically illustrated). Similar to description above, the fastening means 50 and 52 are known to those skilled in the art and include, but are not limited to zippers, buttons, snaps, buttons and the like. Now referring to FIGS. 5 and 6 where footwear cover 25 is fastened to coupling member 20, thereby completing the conversion of footwear 15. In this example embodiment, footwear 15 once initially a shoe (FIGS. 1-3), whereby being converted to an ankle boot (FIGS. 5-6).

In a related embodiment, a man's shoe is similarly convertible from a shoe to a boot for inclement weather or back to a shoe from a boot should the weather improve. In yet another related embodiment, such a system would be ideal for converting children shoes to boots and vice versa in case of weather changes or clothing changes while in town or traveling without the use of a specialty tools or complex assembly/disassembly effort or instruction. Additionally this method is advantageous to the business traveler to avoid excess pairs of shoes when traveling to regions where weather is ever-changing and unpredictable.

In another related embodiment, the cover or bootie attachment are attached with a hook and loop system (such as Velcro®) or with decorative buttons. In another related embodiment, convertible shoe design is used with athletes that have suffered an ankle injury and need support to continue playing or for a senior citizen that also has suffered an injury or needs additional ankle support. The various combinations of shoes and boot attachments are made of various materials adaptable for the seasons.

While the invention has been described above in terms of specific embodiments, it is to be understood that the invention is not limited to these disclosed embodiments. Upon reading the teachings of this disclosure many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

The invention claimed is:

1. A footwear conversion system comprising:

a first footwear type, wherein said first footwear type is a pair of shoes, each shoe defining a footwear aperture having a footwear aperture edge;

a footwear cover and a coupling member having a first fastening means aligned along a lower connection edge, a second releasable fastening means aligned along an upper connecting edge, said first fastening means aligned with and connected to said footwear aperture to couple said first footwear type and said coupling member, said second fastening means aligned with and connected to a lower edge of said footwear cover to couple said footwear cover and said coupling member, wherein said coupling member, when coupled together causes said first footwear type and said footwear cover to transform the system into a second footwear type.

2. The footwear conversion system as in claim 1 wherein said first fastening means and second fastening means are selected from a group consisting of buttons and button holes, cooperating snaps, hook and loop fasteners and cooperating components of a zippers.

3. The footwear conversion system as in claim 1 wherein said first footwear is selected from a group consisting of flats, low-heel shoes, tennis shoes and dress shoes.

4. The footwear conversion system as in claim 1 wherein said second footwear type is selected from a group consisting of ankle boots, low-rise boots, snow boots, hiking boots, high-top basketball shoes, cowboy boots, calf-length boots and over-the-calf length boots.

5. The footwear conversion system as in claim 1 wherein said first fastening means and said second fastening means cooperate with one another to cause coupling means to allow removable coupling of said first footwear type and said footwear cover.

6. The footwear conversion system as in claim 1 wherein said first fastening means is different than said second fastening means.

7. The footwear conversion system as in claim 1 wherein said first fastening means and second fastening means are cooperating halves of a zipper.

8. The footwear conversion system as in claim 1 wherein said first fastening means and said second fastening means are cooperating elements of a hook and loop fastener.

9. The footwear conversion system as in claim 1 wherein said coupling member and said footwear cover are capable of being attached while a person foot is disposed within said first footwear type.

* * * * *